US005738119A

United States Patent [19]

Edwards, III et al.

[11] Patent Number: 5,738,119

[45] Date of Patent: Apr. 14, 1998

[54] FILTER MATERIALS

[75] Inventors: William B. Edwards, III, Richmond; Navin Gautam, Midlothian; Paul N. Gauvin, Chesterfield; Donald E. Laslie, Midlothian; Kenneth A. Newman, Prince George, all of Va.; Calvin R. Woodings, Nuneaton, United Kingdom

[73] Assignee: Courtaulds Fibres (Holdings) Limited, London, United Kingdom

[21] Appl. No.: 765,278

[22] PCT Filed: Jun. 19, 1995

[86] PCT No.: PCT/US95/08841

§ 371 Date: Feb. 21, 1997

§ 102(e) Date: Feb. 21, 1997

[87] PCT Pub. No.: WO95/35044

PCT Pub. Date: Dec. 28, 1995

[30] Foreign Application Priority Data

Jun. 20, 1994 [GB] United Kingdom ..... 9412311

[51] Int. Cl.[6] ..... A24D 3/10

[52] U.S. Cl. ..... 131/331; 131/345

[58] Field of Search ..... 131/331, 332, 131/345; 264/176.1, 178 R; 428/131, 137

[56] References Cited

U.S. PATENT DOCUMENTS 3,485,706 12/1969 Evans .
4,416,698 11/1983 McCorsley, III .

*Primary Examiner*—Vincent Millin
*Assistant Examiner*—Robert N. Wieland
*Attorney, Agent, or Firm*—Fish & Richardson P.C.

[57] ABSTRACT

Cigarette filters which comprise hydroentangled lyocell staple fibers are disclosed. High filter efficiencies, good taste properties, good resistance to staining, good physical resilience and good air flow characteristics are observed when cigarettes containing such filters are smoked.

20 Claims, No Drawings

FILTER MATERIALS

This invention relates to filter body materials in cigarette filters.

Fibre-containing filters for cigarettes are well known. In one known form of construction, the filter body consists of a tow of continuous filaments, commonly cellulose acetate (acetate) filaments, arranged parallel to the long axis of the cigarette. In another known form of construction, the filter body consists of pleated or fluted paper compressed into a cylinder. Such forms of construction contain a single filter element and may be called 'mono' filters. Another known form of construction is the so-called 'dual' filter which contains two filter elements, for example a paper filter towards the interior and a tow filter towards the exterior of the cigarette. A further known form of construction is the so-called 'triple' filter, which resembles a dual filter except that a quantity of activated carbon or other material is interposed between the two filter elements hereinbefore mentioned.

Paper filters are known to be generally more efficient than tow filters at removing tar from tobacco smoke. High tar removal efficiency is particularly desirable in view of the trend towards low-tar cigarettes. Paper filters absorb moisture from the tobacco smoke as the cigarette is smoked, with the result that they become soggy and easy to compress, and offer increased resistance to the passage of smoke through the filter. The external end of a cigarette filter generally becomes stained as the cigarette is smoked. It is known that acetate filters generally exhibit a light tan, uniform staining, whereas paper filters generally exhibit a darker, mottled staining, the latter effect being visually undesirable. Mono paper filters are generally less expensive to manufacture than acetate tow filters even though the manufacturing process is more complex, because paper is a cheaper material than acetate. Dual filters are generally more expensive to manufacture than either mono paper or tow filters because the manufacturing process is more complex, and triple filters are more expensive still. It is an object of the present invention to provide a cigarette filter with high tar removal efficiency which overcomes at least some of the disadvantages associated with those conventional paper filters which comprise paper in the filter body.

The present invention provides a cigarette filter characterised in that the body of the filter comprises a hydroentangled fabric which comprises lyocell staple fibres. The present invention further provides a cigarette incorporating such a filter.

Lyocell fibres are known materials, and their manufacture is described for example in U.S. Pat. No. 4,246,221. They are readily biodegradable. They are available commercially from Courtaulds plc. They are made by dissolving cellulose in a solvent and extruding the solution so formed through a spinnerette into a coagulating bath which serves to precipitate the cellulose and wash the solvent from the fibre. This process may be called solvent-spinning, and lyocell fibres may also be called solvent-spun cellulose fibres. The cellulose is usually woodpulp. The solvent may be a tertiary amine N-oxide, preferably N-methylmorpholine N-oxide, and in general contains a small proportion of water. If the solvent is a tertiary amine N-oxide, the coagulating bath is preferably an aqueous bath. Fabrics which consist essentially of lyocell fibres may be called lyocell fabrics. The solvent-spinning process is to be distinguished from other known processes for the manufacture of cellulose fibres which rely on the formation and decomposition of a chemical derivative of cellulose, for example the viscose process.

Hydroentangling is a process for forming a fabric by mechanically wrapping and knotting fibres in a web about each other through the use of high velocity jets or curtains of water. The web may in general comprise one or more layers of parallelised staple fibres, for example carded webs. When two or more layers are used, the layers may be arranged so that the fibres lie essentially parallel to each other or preferably so that the fibres in the various layers lie at angles to each other. This latter form of construction provides more uniform physical properties, for example tear strength, in the plane of the fabric in various directions. The web may alternatively comprise one or more layers, preferably one layer, of paper and one or more layers of parallelised staple fibres. The paper may comprise lyocell fibres and/or other types of fibres, for example woodpulp and acetate fibres alone or in blend. Hydroentangled fabrics may also be called spunlace fabrics. Hydroentangled fabrics contain little or no binder. Hydroentangling processes and hydroentangled fabrics are described in U.S. Pat. No. 3,485,706, the contents of which are herein incorporated byway of reference.

The hydroentangled fabric may consist solely of or essentially wholly of lyocell fibres. Alternatively, the fabric may consist of a blend of lyocell fibres with one or more other types of fibre known for use in cigarette filters, for example cellulose acetate fibres or woodpulp fibres. The layers used to form the web which is submitted to the hydroentangling process each may consist of a single type of fibre or may consist of a blend of staple fibres. The compositions of the various layers may be the same or different. The hydroentangled fabric may comprise at least 25 percent, at least 50 percent or at least 75 percent by weight lyocell fibres.

The basis weight of the hydroentangled fabric may in general be similar to that of the paper used in known paper filters, and may generally be in the range 15 to 150 grams per square meter, preferably 20 to 80 grams per square meter. The number of layers in the web of fibre submitted to the hydroentangling process may be in the range 1 to 10, preferably 1 to 5.

The titre of the lyocell fibres and of the optional other types of fibre may generally be in the range 0.05 to 20, often 1 to 5 decitex.

The fibre contained in the hydroentangled fabric is preferably fibrillated. Lyocell fibres may be fibrillated by subjecting them to mechanical abrasion in the wet state, as for example during a hydroentangling process. Fibrillation results in the partial detachment of thin fibres ('fibrils') from the body of the fibre, so that the individual fibres acquire a 'hairy' appearance. Fibrillated lyocell fibres have an increased surface area compared with unfibrillated fibres, and it is thought that this may be advantageous in providing efficient filtration.

The hydroentangled fabric is arranged in the filter body so that the long axis of the cigarette lies parallel to the general plane of the fabric. The fabric is preferably a pleated or fluted fabric. The fabric can be converted into filters on conventional equipment for the manufacture of paper filters. It has been found that hydroentangled fabric can often be processed more rapidly on such equipment than paper, thereby reducing production costs.

The hydroentangled fabric may be used in place of paper to make filters of known forms of construction, for example dual, triple and in particular mono filters.

The cigarette filter of the invention has been found to have a high filtration (particulate removal) efficiency in comparison with known cellulose acetate tow filters and a similar filter efficiency to some known paper filters. The filter of the invention reduces the 'papery' or other unpleasant taste to the cigarette. This is surprising because lyocell fibres are cellulose fibres. It is well known that conventional types of cellulose fibre, for example woodpulp and viscose rayon, do impart such a 'papery' taste. The visual appearance (staining pattern) of the end of the filter of the invention when the cigarette is smoked is comparable to that of conventional cellulose acetate tow filters, and is considerably better than that of conventional paper filters. The filter of the invention retains good physical resilience (resistance to compression) and air flow characteristics when the cigarette is smoked. This is remarkable for a filter containing cellulose fibres. The filter of the invention may advantageously be a mono filter.

The invention is illustrated by the following Examples:

EXAMPLE 1

Lyocell fibre (1.7 decitex, 25 mm staple, semi-matt, available from Courtaulds plc) was carded to form a web. Two webs were combined and hydroentangled using 8 nozzles and a peak pressure of 100 bar to produce a hydroentangled lyocell fabric of basis weight 33 $gm^{-2}$. The tensile strength and elongation of the fabric in the machine and cross directions were respectively 3.6 and 1.7 kg/in and 24.1 and 72.7%.

The fabric was corrugated and made into cigarette filters on conventional equipment for the manufacture of paper filters. Rod quality was assessed as excellent. Filter rod properties in comparison with conventional paper and cellulose acetate (CA) tow filters are shown in Table 1 (percentage coefficients of variation are given in parentheses).

TABLE 1

| Type | Rod Weight g | Circumference (mm) | Rod RTD | 27 mm Tip RTD | Filter Efficiency % | Hardness % Filtrona |
|---|---|---|---|---|---|---|
| Lyocell | 0.882 | 24.37 | 606 | 155 | 73 | 92.1 |
| (A) | (2.8) | (0.2) | (6.1) | | | (15.0) |
| Lyocell | 0.803 | 24.49 | 429 | 113 | 66 | 86.1 |
| (B) | (1.9) | (0.2) | (3.7) | (3.3) | | (9.9) |
| Paper | 0.857 | 24.46 | 433 | 119 | 76 | 89.6 |
| | (0.7) | (0.2) | (2.7) | (2.9) | | (9.8) |
| CA Tow | — | — | — | 100 | 68 | — |
| CA Tow | — | — | — | 154 | 67 | — |

Cigarettes were made using the lyocell (sample B), paper and cellulose acetate filters and evaluated subjectively in smoking tests. The results showed subjective parity between the cigarettes with the lyocell and paper filters, although it was felt that the cigarette model was not optimised for the lyocell filter. Results are given in Table 2.

TABLE 2

| | Cellulose Acetate | Lyocell | Paper |
|---|---|---|---|
| Smoke | | | |
| Butt Length, mm | 35.0 | 35.0 | 35.0 |
| FTC Tar, mg/cigarette | 4.5 | 4.4 | 3.8 |
| TPM, mg/cigarette | 5.4 | 5.1 | 4.4 |
| Nicotine, mg/cigarette | 0.44 | 0.37 | 0.32 |
| Water, mg/cigarette | 0.43 | 0.39 | 0.33 |
| Puffs per Cigarette | 7.7 | 7.4 | 7.2 |
| Filtration Efficiency % | 62 | 69 | 77 |
| Cigarette | | | |
| Total RTD, mm of $H_2O$ | 111 | 117 | 112 |
| Static Burn Time, min | 7.2 | 7.2 | 7.4 |
| Filter | | | |
| RTD, mm of $H_2O$ | 130 | 122 | 123 |
| Tipping Paper Length, mm | 32.0 | 32.0 | 32.0 |
| Ventilation % | 51 | 43 | 36 |

EXAMPLE 2

Lyocell fibre (1.7 dtex, 25 mm) was laid as webs and hydroentangled to form fabric as described in Example 1. Further details and fabric properties are shown in Table 3:

TABLE 3

| Ref. | Fibre lustre | Target | Basis wt. $g/m^2$ | Thickness mm |
|---|---|---|---|---|
| A | Matt | 34 $g/m^2$ | 33.2 | 0.33 |
| B | Bright | 34 $g/m^2$ | 36.6 | 0.36 |
| C | Bright | 29 $g/m^2$ | 30.5 | 0.33 |
| D | Bright | 39 $g/m^2$ | 42.4 | 0.38 |
| E | Bright | As B, high MD orientation | 32.9 | 0.39 |
| F | Bright | As B, high needling pressures | 36.6 | 0.32 |
| G | Bright | As B, high squeeze/low thickness | 37.6 | 0.35 |
| H | Bright | As B, backed with paper | 59.0 | 0.34 |
| I | Bright | As B, embossed | 39.7 | 0.36 |
| J | Matt | As A, embossed | 35.6 | 0.34 |

MD=machine direction. In sample H, lyocell fibre was dry-laid onto lyocell paper to provide a composite which was then submitted to hydroentanglement. Samples I and J were embossed by hydroentangling while laid on a belt carrying a 24 mesh challis pattern. Cigarette filters were manufactured from webs A–J. Further details and experimental results are shown in Table 4.

TABLE 4

| Ref | Web Width mm | Corr level | Rod Wt g | CV | Rod Circ mm | CV | Rod RTD | CV | RTD 24.20C | 27 mm Tip PD | FE % |
|---|---|---|---|---|---|---|---|---|---|---|---|
| A | 200 | 275 | 0.779 | 1.8 | 24.27 | 0.7 | 469 | 3.4 | 477 | — | — |
| | | 325 | 0.787 | 1.4 | 24.24 | 0.3 | 495 | 3.0 | 500 | 132.0 | 66 |

TABLE 4-continued

| Ref | Web Width mm | Corr level | Rod Wt g | CV | Rod Circ mm | CV | Rod RTD | CV | RTD 24.20C | 27 mm Tip PD | FE % |
|---|---|---|---|---|---|---|---|---|---|---|---|
| | | 375 | 0.771 | 1.4 | 24.19 | 0.4 | 490 | 3.4 | 489 | — | — |
| B | 200 | 275 | 0.886 | 1.5 | 24.31 | 0.3 | 482 | 5.3 | 495 | — | — |
| | | 325 | 0.883 | 1.5 | 24.39 | 0.4 | 527 | 3.8 | 552 | 139.2 | 69 |
| | | 375 | 0.898 | 1.3 | 24.43 | 0.4 | 612 | 3.0 | 648 | — | — |
| C | 200 | 250 | 0.751 | 1.9 | 24.12 | 0.3 | 356 | 5.2 | 349 | — | — |
| | | 275 | 0.768 | 2.9 | 24.26 | 0.3 | 425 | 5.2 | 431 | 115.3 | 64 |
| | | 325 | 0.717 | 1.3 | 24.19 | 0.4 | 390 | 3.4 | 389 | — | — |
| D | 200 | 300 | 0.937 | 1.4 | 24.58 | 0.5 | 583 | 5.2 | 640 | 154.3 | 71 |
| | | 350 | 0.926 | 1.0 | 24.61 | 0.5 | 623 | 2.9 | 689 | — | — |
| | | 400 | 0.923 | 1.7 | 24.74 | 0.6 | 641 | 3.4 | 732 | — | — |
| E | 200 | 275 | 0.810 | 1.4 | 24.24 | 0.3 | 422 | 2.9 | 426 | — | — |
| | | 325 | 0.820 | 1.3 | 24.28 | 0.5 | 454 | 3.1 | 463 | — | — |
| | | 375 | 0.820 | 1.1 | 24.38 | 0.5 | 464 | 2.8 | 485 | 123.2 | 66 |
| F | 200 | 275 | 0.903 | 1.8 | 24.41 | 0.5 | 514 | 4.5 | 541 | 139.4 | 73 |
| | | 325 | 0.910 | 1.2 | 24.46 | 0.4 | 561 | 3.0 | 598 | — | — |
| | | 375 | 0.913 | 1.4 | 24.43 | 0.5 | 611 | 3.9 | 647 | — | — |
| G | 200 | 275 | 0.838 | 1.6 | 24.42 | 0.4 | 482 | 4.6 | 509 | — | — |
| | | 325 | 0.847 | 1.3 | 24.45 | 0.5 | 506 | 3.7 | 538 | 132.0 | 68 |
| | | 375 | 0.834 | 2.3 | 24.48 | 0.5 | 520 | 4.1 | 557 | — | — |
| H | 200 | 290 | 1.362 | 0.8 | 24.58 | 0.9 | — | — | — | — | — |
| | | 310 | 1.344 | 1.0 | 24.60 | 0.5 | — | — | — | — | — |
| | | 330 | 1.354 | 0.9 | 24.59 | 0.4 | — | — | — | — | — |
| I | 200 | 275 | 0.904 | 1.3 | 24.42 | 0.5 | 489 | 2.9 | 516 | — | — |
| | | 325 | 0.917 | 2.3 | 24.48 | 0.5 | 523 | 5.4 | 560 | — | — |
| | | 375 | 0.895 | 1.3 | 24.53 | 0.6 | 522 | 3.5 | 566 | 140.3 | 70 |
| J | 200 | 275 | 0.845 | 1.2 | 24.06 | 0.3 | 387 | 3.2 | 374 | — | — |
| | | 325 | 0.847 | 1.3 | 24.13 | 0.3 | 431 | 2.5 | 424 | — | — |
| | | 375 | 0.881 | 1.5 | 24.14 | 0.3 | 535 | 3.9 | 527 | 140.1 | 71 |
| HA | 150 | 290 | 1.052 | 0.6 | 24.25 | 0.4 | 956 | 6.0 | 968 | — | — |
| | | 310 | 1.064 | 0.7 | 24.17 | 0.5 | 1004 | 7.0 | 997 | — | — |
| | | 330 | 1.064 | 0.9 | 24.21 | 0.5 | 999 | 5.5 | 1001 | — | — |
| HB | 120 | 290 | 0.862 | 1.2 | 24.06 | 0.5 | 415 | 5.2 | 401 | 125.9 | 80 |
| | | 310 | 0.861 | 1.1 | 24.11 | 0.3 | 411 | 4.8 | 402 | 122.0 | 79 |
| | | 330 | 0.875 | 1.0 | 24.11 | 0.4 | 426 | 3.4 | 417 | 130.3 | 80 |

(1) A dash in the Table indicates that no measurement was made. (2) Corr. Level=Corrugation Level, the value quoted being the machine corrugation force setting in arbitrary units. Each web was converted into filters at three corrugation forces: at the minimum force which produced a filter with an acceptably low variation in filter pressure drop; at the maximum force that could be applied without splitting of the web; and at the midpoint between these two forces. The minimum and maximum forces define the capability range of the material. (3) CV=Coefficient of Variation %. (4) RTD=resistance to draw in mm of water. (5) RTD 24.20C= resistance to draw in mm of water normalised to 24.20 mm filter circumference. (6) 27 mm tip PD=pressure drop along a 27 mm section of filter rod in mm of water. (7) FE=filter efficiency, measured as percentage removal of total available particulate matter.

For comparison, the filter effiency of a conventional 27 mm paper tip increases linearly from 65% at RTD 60 mm to 90% at RTD 200 mm. The filter efficiency of a conventional 27 mm acetate tip is 59% at RTD 100 mm, 67% at RTD 152 mm, and 72% at RTD 195 mm.

We claim:

1. A cigarette filter, characterised in that the body of the filter comprises a hydroentangled fabric which comprises lyocell staple fibres.

2. A cigarette filter according to claim 1, characterised in that the basis weight of the hydroentangled fabric is in the range 15 to 150 grams per square meter.

3. A cigarette filter according to claim 2, characterised in that the basis weight of the hydroentangled fabric is in the range 20 to 80 grams per square meter.

4. A cigarette filter according to claim 1, characterised in that the hydroentangled fabric is made by subjecting a web comprising 1 to 10 layers of parallelised fibres to a hydroentangling process.

5. A cigarette filter according to claim 4, characterised in that the web contains 2 to 10 layers and the fibres in the layers lie at angles to each other.

6. A cigarette filter according to claim 1, characterised in that the hydroentangled fabric is made by subjecting a web comprising one or more layers of parallelised fibres and a layer of paper to a hydroentangling process.

7. A cigarette filter according to claim 1, characterised in that the lyocell fibres are fibrillated.

8. A cigarette filter according to claim 1, characterised in that the hydroentangled fabric consists essentially of lyocell fibres.

9. A cigarette filter according to claim 1, characterised in that it is a mono filter.

10. A cigarette filter according to claim 1, characterised in that the lyocell fibres are made by a process including the step of extruding a solution of cellulose in a solvent which comprises tertiary amine N-oxide into an aqueous coagulation bath.

11. A cigarette comprising a filter having a body, wherein the body of the filter comprises a hydroentangled fabric which comprises lyocell staple fibres.

12. A cigarette according to claim 11, wherein the basis weight of the hydroentangled fabric is in the range 15 to 150 grams per square meter.

13. A cigarette according to claim 12, wherein the basis weight of the hydroentangled fabric is in the range 20 to 80 grams per square meter.

14. A cigarette according to claim 11, wherein the hydroentangled fabric is made by subjecting a web comprising 1 to 10 layers of parallelised fibres to a hydroentangled process.

15. A cigarette according to claim 14, wherein the web contains 2 to 10 layers and the fibres in the layers lie at angles to each other.

16. A cigarette according to claim 11, wherein the hydroentangled fabric is made by subjecting a web comprising one or more layers of parallelised fibres and a layer of paper to a hydroentangling process.

17. A cigarette according to claim 11, wherein the lyocell fibres are fibrillated.

18. A cigarette according to claim 11, wherein the hydroentangled fabric consists essentially of lyocell fibres.

19. A cigarette according to claim 11, wherein the filter is a mono filter.

20. A cigarette according to claim 11, wherein the lyocell fibres are made by a process including the step of extruding a solution of cellulose on a solvent which comprises tertiary amine N-oxide into an aqueous coagulation bath.

* * * * *